US005511253A

United States Patent [19]

Zamudio-Castillo et al.

[11] Patent Number: 5,511,253

[45] Date of Patent: Apr. 30, 1996

[54] DUAL FLUSH SYSTEM FOR A TOILET TANK

[75] Inventors: Mario-Rodolfo Zamudio-Castillo; Francisco Vazquez-Acosta; Francisco-Javier Melendez-Rodriguez, all of Nuevo León, Mexico

[73] Assignee: Sanitarios Azteca, Nuevo Leon, Mexico

[21] Appl. No.: 263,060

[22] Filed: Jun. 21, 1994

[51] Int. Cl.[6] ..... E03D 1/14

[52] U.S. Cl. ..... 4/325

[58] Field of Search ..... 4/324, 325

[56] References Cited

U.S. PATENT DOCUMENTS

| | | | |
|---|---|---|---|
| 4,135,262 | 1/1979 | Overbey | 4/325 |
| 4,216,555 | 8/1980 | Detjen | 4/324 |
| 4,651,359 | 3/1987 | Battle | 4/325 X |
| 4,882,793 | 11/1989 | Thompson | 4/325 X |
| 5,235,707 | 8/1993 | Wang-on | 4/324 |

*Primary Examiner*—Charles E. Phillips
*Attorney, Agent, or Firm*—Abelman, Frayne & Schwab

[57] ABSTRACT

A dual flush system for a toilet tank, to choice a desired flush volume of water from said tank to flush solids or liquids, depending on the operation of a two-position flush lever, comprising: a latching plate coupled to the overflow tube, having a latching aperture and a tilting gate connected to the flush lever mechanism; a secondary buoyant float slide retained by the overflow tube, having a latch member coupled thereto and connected to the flush lever, passing through the aperture of the latching plate; and a shoe rod coupled to said secondary buoyant float to push the stopper when it is discharging a first volume of water to flush liquids from the toilet bowl. For flushing solids, the flush lever is operated to a first intermediate position, lifting only the stopper causing a total flush of water because the latch member is latched by the tilting gate of the latch plate and the buoyant float as well as the shoe rod remain inoperative. When flushing liquids, the flush lever is operated to a second position lifting the tilting gate loosing the latch member allowing the secondary buoyant float to fall down together with the shoe rod to push the stopper impeding a total discharge of water.

1 Claim, 2 Drawing Sheets

DUAL FLUSH SYSTEM FOR A TOILET TANK

FIELD OF THE INVENTION

This invention is related to a dual flush system for a toilet tank and more particularly to a dual flush system for flushing different volumes of water for flushing liquids or solids, depending on the operation of a two-position flushing lever.

DESCRIPTION OF THE RELATED ART

There are a number of known dual flush systems selectively operable to discharge different volumes of water from a toilet tank.

The most common type of dual flush system comprise one or two fluid-intercommunicated flushing tubes including two stopper valves placed at different levels on said flushing tubes, which are operated by a two position flush lever or by two independent operable flush levers, such as those disclosed in U.S. Pat. Nos. 3,758,893; 3,795,016; 3,906,554; 4,042,982; 4,829,605; 4,878,256 and 5,005,225.

That type of dual flush system has the disadvantage that, as the fluid-intercommunicated tube or tubes have to be prefabricated with pre-established dimensions related to a specifically manufactured toilet tank, they cannot be used for different sized toilet tanks which are not standardized. Therefore, they have to be produced specifically for a limited type of toilet tank.

Another type of dual flush system is operable by two different flush levers providing different aperture levels for the stopper valve, in which the user has to select the lever for a partial or total flushing and has to press such lever for a period of time corresponding to a respective flushing. This type of dual flush system is disclosed in U.S. Pat. Nos. 4,837,867 and 4,864,665.

Finally, there are an ample variety of mechanisms which are more or less complicated and include a number of components, such as those disclosed in U.S. Pat. Nos. 4,700,413; 4,881,279; 4,910,812; 4,945,580; 5,003,644; 5,070,547 and 5,081,720, among others.

In order to simplify the mechanisms of the dual flush systems of the prior art patents, applicants provide a simplified dual flush system for a toilet tartly, which is adaptable to any type of toilet tank because it can be sized for a desired partial flush volume in accordance with any particular toilet tank.

Such a dual flush system for a toilet tank, in accordance with the present invention, allows the user to choose a desired flush volume of water from said tank to flush solids or liquids, depending on the operation of a two-position flush lever. Such a dual flush system comprises a latching plate in said toilet tank, having a latching aperture and a tilting gate operable by the flush lever; a secondary buoyant float slide retained in said toilet tank, having a latch member coupled thereto and connected also to the flush lever, passing through the aperture of the latching plate; and a shoe rod coupled to said secondary buoyant float slide to push the stopper interrupting the flush to discharge a first volume of water to flush liquids from the toilet bowl. For flushing solids, the flush lever is operated to a first intermediate position, lifting only the stopper causing a total flush of water because the latch member is latched by the tilting gate of the latch plate. When flushing liquids, the flush lever is operated to a second position lifting the tilting gate, releasing the latch member, and allowing the secondary buoyant float to fall down together with the shoe rod to push the stopper impeding a total discharge of water.

SUMMARY OF THE INVENTION

It is therefore a main object of the present invention, to provide a dual flush system for a toilet tank, for flushing different volumes of water for flushing liquids or solids, depending on the operation of a two-position flush lever.

It is also a main object of the present invention, to provide a dual flush system for a toilet tank, of the above disclosed nature, which permits the saving of water by allowing the user to choose a decreased discharge volume of water when flushing liquids.

It is still another main object of the present invention, to provide a dual flush system for a toilet tank, of the above disclosed nature, including a simplified latching system which operates, on a first position of the flush lever, over a shoe rod to push the stopper before a complete discharge, for flushing liquids and remains inoperative, on a second position of the flush lever, to flush solids.

These and other objects and advantages of the present invention will be apparent from the following description of a specific preferred embodiment thereof.

DESCRIPTION OF A PREFERRED EMBODIMENT OF THE INVENTION

Figure 1:
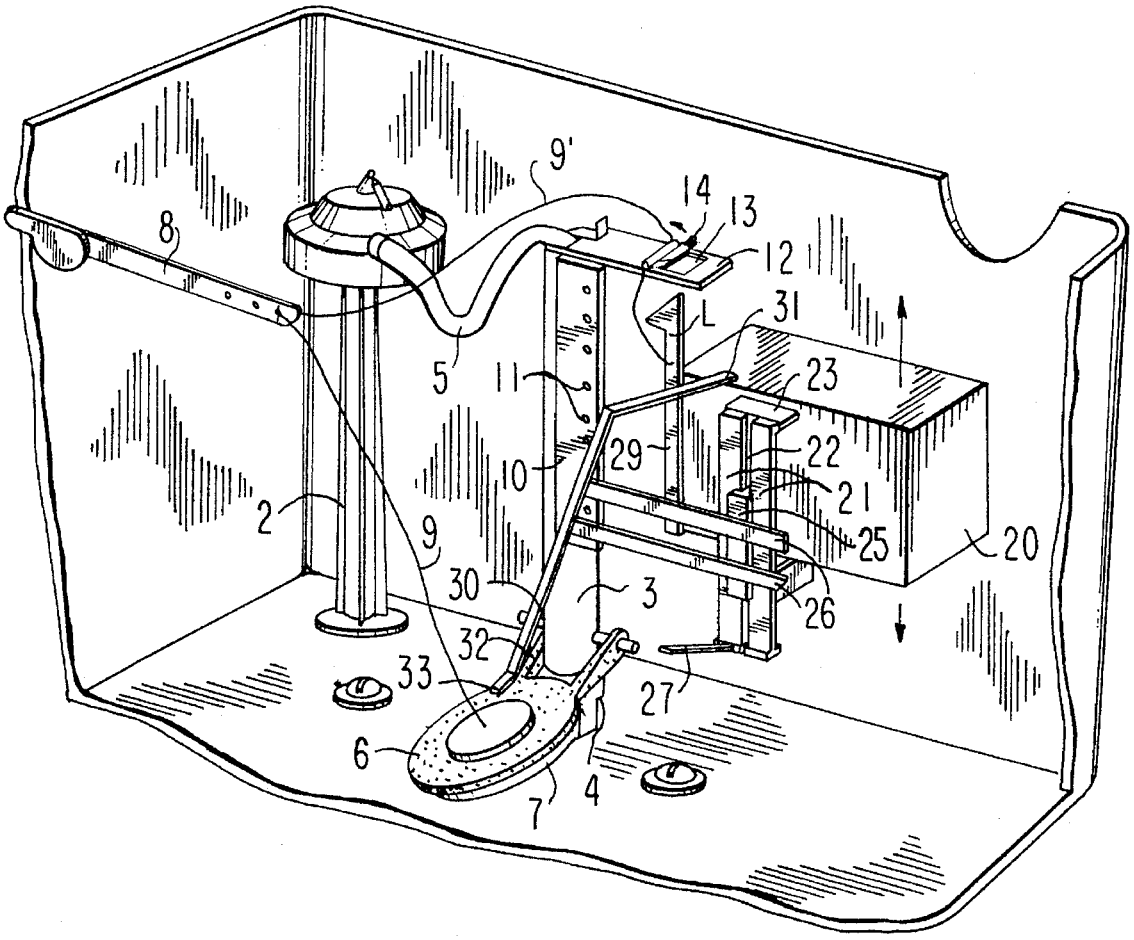
FIG. 1 is a perspective view of a toilet tank, in partial cross-section, showing the dual flush system of the present invention.
Figure 2:
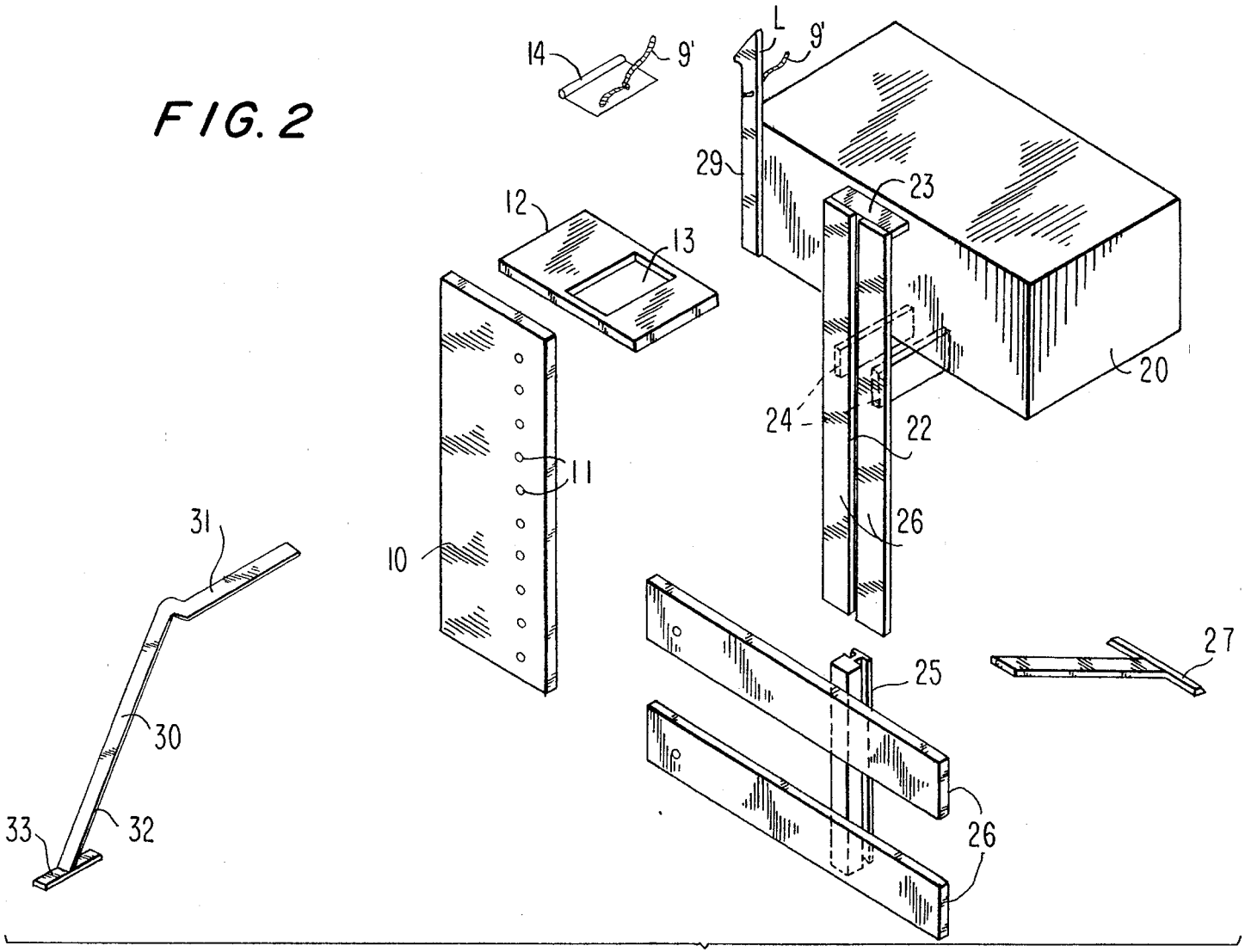
FIG. 2 is an exploded perspective view of the dual flush system of the present invention, showing all of its components.

The dual flush system of the present invention, will be now described in accordance with a preferred embodiment thereof shown in the accompanying drawings, and referring to a typical water closet.

A typical water closet includes a toilet bowl (not illustrated) and a toilet tank 1 comprising: a filling valve 2 connected to a water line (not illustrated) and securely coupled to the bottom of the tank 1, which is operated by a buoyant float (not illustrated) connected therewith, to open the filling valve 2 after a flush discharge and close said filling valve 2 when the tank 1 is at a desired water level; an overflow tube 3 coupled to an overflow opening 4 at the bottom of the tank 1, to discharge the water in case the tank is filled beyond the desired level; a flexible conduit 5 connected to the filling valve 2 and to the overflow tube 3, to fill the bowl to a desired level after a flush discharge; and a flush stopper 6 pivotally mounted on a lower end of the overflow tube 3 at a point pin, coupling to a discharge opening 7 at the bottom of the tank 1, and operated by a flush lever 8 connected to said stopper 6 by a cord 9 or the like.

A dual flush system for said toilet tank, to choose the desired level of water in said tank depending on the two-position operation of the flush lever 8, comprises:

a vertical set plate 10 coupled to the overflow tube 3, having a plurality of perforations 11 corresponding to a desired level of water to be flushed from the tank, and a latching plate 12 coupled perpendicularly to the top of said overflow tube 3, having a latching aperture 13 and a tilting gate 14 coupled to an intermediate portion of a cord 9' (or a chain or the like) of the flush lever 8;

a secondary buoyant float 20 having a pair of vertical parallel beams 21, separated from each other by a slot 22 and attached at their upper ends to a horizontal plate 23 coupled to the buoyant float 20 and at their intermediate portions to plates 24 also coupled to the buoyant float 20, a slide shoe 25 fitted through the slot 22, between the pair of parallel beams 21; said buoyant float 20 being slidingly retained by a pair of horizontal beams 26 perpendicularly coupled at one of their ends to the slide shoe 25 and at their other ends to the desired perforations 11 of the vertical set plate 10; the traveling of the slide shoe 25 through the slot 22, being limited, at an upper end, by the horizontal plate 23 and, at a lower end, by a stop member 27 coupled at the lower end of the beams 21, to prevent the slide shoe 25 from leaving the slot 22; a latch member 29 being coupled to the buoyant float 20 and having an upper latch end L connected to the cord 9', chain or the like of the flush lever 8, passing through and in coincidence with the aperture 13 of the latching plate 12; and a shoe rod 30 coupled at its top end 31 to the top of said secondary buoyant float 20 and having a shoe 33 at its lower end 32 to push the stopper 6 by the descending action of the buoyant float 20, when discharging a first volume of water to flush liquids from the toilet bowl.

Normally, the secondary buoyant float 20 is maintained in a top position because at the full level of water in the toilet tank, the latch end L of the latch member 29 is latched over the tilting gate 14 of the latching plate 12 and consequently the shoe rod 30 is at an elevated inoperative position.

For flushing solids from the toilet bowl, the flush lever 8 is operated down to a first intermediate position, lifting only the stopper 6 causing a total flush of water from the toilet tank 1 because the latch member 29 remains latched by the tilting gate 14 of the latching plate 12.

However, when flushing liquids normally requiring less water, the flush lever 8 is operated down to a second lower position causing lifting of the tilting gate 14 which releases the latch member 29 so that on the descent of the secondary buoyant float 20, the shoe rod 30 also descends pushing the stopper 6 and impeding a total discharge of water from the toilet tank 1.

The vertical set plate to which the buoyant float is attached, as well as the latch plate, can be coupled or pasted to a wall of the toilet tank instead of being coupled to said overflow tube.

Furthermore, it is to be understood that other components or mechanisms for slidably retaining said buoyant float can be used instead of those already disclosed. This is also true for the latching means, which can be any other type of latching means.

It is therefore to be understood that the invention is not limited to the above disclosed embodiment and that the persons skilled in the art could suggest changes in the type and design of components of the system of the present invention, derived from the teachings herein disclosed, which will be within the true spirit and scope of this invention as claimed in the following claims.

What is claimed is:

1. In a water closet comprising a toilet bowl and a toilet tank, including a water filling valve and an overflow tube coupled toy the tank, and a buoyant flush stopper seated in a discharge opening in the tank, said stopper being operated by a flush lever connected thereto upon actuation of a flush lever;

a dual flush system for said toilet tank, to select a full or partial flush volume of water from said tank, comprising:

a latching plate coupled to said tube, having a latching aperture and a tilting gate pivotally mounted to said plate for closing and opening said aperture, said plate being connected to said lever to assume an open position with said lever in a first position;

a secondary buoyant float having two vertical parallel beams coupled thereto, defining a slide slot between them, a slide shoe coupled to a beam retained by the overflow tube, so that the secondary buoyant float is slidably guided by the parallel beams through the shoe in response to changes of water level in the toilet tank, the secondary buoyant float also having a latch member coupled thereto, said latch member being adapted to pass through the latching aperture of the latching plate and be retained by the tilting gate for a total discharge of the tank when flushing solids, by operation of the flush lever to a first position which lifts only the stopper; and, a shoe rod coupled to the secondary buoyant float, so as to push the stopper from a floating to a seated position to discharge a partial volume of water, by operation of the flush lever to a second position which lifts the tilting gate and releases the latch member from the latching plate and allows the buoyant float to descend in response to the level of water in said toilet tank, thus pushing said shoe rod against the stopper to interrupt the flush.

* * * * *